US007613609B2

(12) United States Patent
Makino

(10) Patent No.: US 7,613,609 B2
(45) Date of Patent: Nov. 3, 2009

(54) APPARATUS AND METHOD FOR ENCODING A MULTI-CHANNEL SIGNAL AND A PROGRAM PERTAINING THERETO

(75) Inventor: Kenichi Makino, Kanagawa (JP)

(73) Assignee: Sony Corporation (JP)

( * ) Notice: Subject to any disclaimer, the term of this patent is extended or adjusted under 35 U.S.C. 154(b) by 678 days.

(21) Appl. No.: 10/816,643

(22) Filed: Apr. 2, 2004

(65) Prior Publication Data

US 2004/0225495 A1 Nov. 11, 2004

(30) Foreign Application Priority Data

Apr. 9, 2003 (JP) ..... P2003-105642

(51) Int. Cl.
*G10L 19/02* (2006.01)
*G10L 19/00* (2006.01)

(52) U.S. Cl. ..... 704/229; 704/200; 704/200.1; 704/201; 704/501; 704/503

(58) Field of Classification Search ..... 704/229, 704/501, 503, E19.005, 200, 200.1, 201
See application file for complete search history.

(56) References Cited

U.S. PATENT DOCUMENTS 5,241,535 A * 8/1993 Yoshikawa ..... 370/394
5,285,498 A * 2/1994 Johnston ..... 381/2
5,537,510 A * 7/1996 Kim ..... 704/229
5,555,273 A * 9/1996 Ishino ..... 375/244
5,613,035 A * 3/1997 Kim ..... 704/229
5,627,937 A * 5/1997 Kim ..... 704/229
5,963,256 A * 10/1999 Tahara ..... 348/385.1
7,050,972 B2 * 5/2006 Henn et al. ..... 704/228
2002/0120442 A1 * 8/2002 Hotta ..... 704/229

FOREIGN PATENT DOCUMENTS

JP 03-220920 A 9/1991
JP 5-037396 A 2/1993
JP 07-160292 A 6/1995
JP 07-175499 A 7/1995
JP 07-181998 A 7/1995
JP 2001-007707 A 1/2001

* cited by examiner

*Primary Examiner*—Richemond Dorvil
*Assistant Examiner*—Douglas C Godbold
(74) *Attorney, Agent, or Firm*—Lerner, David, Littenberg, Krumholz & Mentlik, LLP

(57) ABSTRACT

To encode multi-channel digital data by adjusting the number of bits allocated to each channel to perform entropy coding of the multi-channel data, there is provided a multi-channel encoder including n encoders for audio data from n channels and an inter-channel bit allocator that allocates the number of bits usable for each channel on the basis of the provisional number of in-use bits from each of the encoders. Each of the encoders performs entropy coding on the basis of the provisional number of quantizing steps, outputs the provisional number of in-use bits resulting from summing of a code length of each unit of coding, and adjusts the number of in-use bits by updating the quantizing steps correspondingly to the number of bits supplied based on the provisional number of in-use bits. Also, the inter-channel bit allocator allocates the total number of usable bits as the number of bits determined correspondingly to a ratio of each provisional number of in-use bits with the sum of all the proportional numbers of in-use bits.

15 Claims, 7 Drawing Sheets

APPARATUS AND METHOD FOR ENCODING A MULTI-CHANNEL SIGNAL AND A PROGRAM PERTAINING THERETO

BACKGROUND OF THE INVENTION

1. Field of the Invention

The present invention relates to an encoding apparatus, method and program for simultaneously recording or reproducing multi-channel audio data or the like from many channels by a so-called high-efficiency coding.

This application claims the priority of the Japanese Patent Application No. 2003-105642 filed on Apr. 9, 2003, the entirety of which is incorporated by reference herein.

2. Description of the Related Art

Heretofore, there have been proposed various techniques of high-efficiency coding of audio or sound signals. They include the so-called subband coding (SBC) in which a time-axial audio signal or the like is encoded by dividing the frequency band of the signal into a plurality of frequency bands without blocking or framing the signal, the so-called transform coding in which a time-axial signal is blocked or framed in units of a predetermined time, the time-axial signal is transformed frame by frame into a signal frequency-axial one (by spectrum transform) and divided into a plurality of frequency bands, and encoded band by band, etc., for example. Also, there has been proposed a high-efficiency coding technique which is a combination of the subband coding and transform coding techniques. In this case, the frequency band of a signal is divided into subbands by the subband coding technique, then the signal in each subband is orthogonal- or spectrum-transformed band by band into a frequency-axial signal, and the spectrum-transformed signal is encoded band by band.

Note that the aforementioned subband coding (SBC) uses a subband filter such as quadrature mirror filter (QMF) or the like. The QMF is referred to in "Digital Coding of Speech in Subbands" (R. E. Crochiere, Bell Syst. Tech. J, Vol. 55, No. 8, 1976). Also, an iso-bandwith filtering technique is disclosed in "Polyphase Quadrature Filters—A New Subband Coding Technique" (Joseph. H. Rothweiler, ICASSP 83, Boston). Further, the aforementioned orthogonal or spectrum transform is such that an input audio signal is blocked or framed in units of a predetermined time and a time-axial signal is transformed block by block or frame by frame into a frequency-axial one by the discrete Fourier Transform (DFT), discrete cosine transform (DCT), modified discrete cosine transform (MDCT) or the like. The MDCT is disclosed in "Subband/Transform Coding Using Filter Bank Design Based on Time Domain Aliasing Cancellation"—J. P. Princen, A. B. Bradley, Univ. of Surrey Royal Melbourne Inst. of Tech. ICASSP, 1987.

Note here that in many cases of quantizing each of frequency subband components, the frequency is divided into a bandwidth determined with the human hearing characteristics being taken in consideration. That is, an audio signal is divided into a plurality of bands (25 bands, for example) called "critical band" whose width is normally larger when the frequency is higher. Also, in encoding the data band by band, a predetermined bit allocation or adaptive bit allocation is done band by band in some cases. For example, in encoding coefficient data resulted from the aforementioned MDCT by the bit allocation, MDCT coefficient data in each band, resulted from the MDCT made frame by frame, will be encoded with an adaptive number of allocated bits. The bit allocation is done by the following two well-known techniques.

One of the two such techniques is referred to in "Adaptive Transform Coding of Speech Signals"—IEEE Transactions of Acoustics, Speech and Signal Processing, Vol. ASSP-25, No. 4, August 1977, in which the bit allocation is done based on the size of a signal in each band. With this technique, the quantization noise spectrum is flat and noise energy is minimum, but the actual noise feeling is not acoustically optimum because no masking effect is utilized. Also, a technique of fixed bit allocation in which the acoustic masking is utilized to provide a necessary signal-to-noise ratio for each band is disclosed in "The Critical Band Coder—Digital Encoding of the Perceptual Requirements of the Auditory System"—M. A. Kranser, MIT, ICASSP, 1980.

Also, the orthogonal transform is often used for encoding of video information as well as of audio information. A typical one of such techniques used for such coding is the discrete cosine transform (DCT). For example, DCT is effected of each block having a size of 8×8 pixels to provide a coefficient of transform and a bit allocation is done with priority given to the low-frequency band. For a higher coding efficiency, an entropy code is frequently used. A larger prediction gain can be assured using an inter-frame prediction signal as input information for the DCT transform in consideration. Also, the inter-frame prediction gain can further be raised using a motion compensation.

There is proposed in the Japanese Patent Application Laid-Open No. H08-123488 a high-efficiency coding technique using a bit allocation that can further raise the efficiency of simultaneous write and read of multimedia information or multiple-content information including video and audio information and determine a time for possible recording before encoding the information.

The high-efficiency coding technique disclosed in the Japanese Patent Application Laid-Open No. H08-123488 is used in a system with video and audio channels to provide a bit allocation in which the total bit rate of all channels including the video and audio channels is variable and will not exceed a constant maximum value in order to assure a recording time as long as possible. On the assumption that the number of bits representing an MDCT coefficient and usable in transmission or recording is 800 bps for example, the tonality of the spectrum information of signal information and over-time change of the signal information are first used to determine the number of bits to be used in a first bit allocation, of the above bits usable in transmission and recording. Also, the ratio of bit sectioning between the first bit allocation pattern and at least another bit allocation to be appended to the first bit allocation pattern depends upon the over-time change characteristic of the information signal. A bit sectioning ratio is determined depending upon how the information signal increase in amplitude in a time domain, in which the information signal suddenly becomes large in amplitude, detected through comparison of peak values of the signal information adjacent block by adjacent block with each other in each time section resulted from subdivision of an orthogonal transform time block size.

With the above high-efficiency coding technique, it is possible to assure a sufficiently long recording time by providing a bit allocation in which the total bit rate of all channels including the video and audio channels is variable and will not exceed a constant maximum value.

However, in the case where the entropy coding is used to reduce the code length in a multi-channel coding system in which information from a plurality of signal channels are encoded together, if a bit allocation is done before encoding the information as in the Japanese Patent Application Laid-pen No. H08-123488, any optimum inter-channel bit allocation cannot simply be calculated because of a data compression ratio in the entropy coding.

Also, once a bit allocation to each channel is fixed in the audio coding system for example, no energy balance between the channels will not be taken in consideration, which leads to an extremely low efficiency of coding.

On the other hand, even if it is tried to calculate the number of bits for allocation to a channel on the basis of the energy proportionality relation in spectral power between blocks, it is difficult to predict the number of entropy codes and assure any appropriate bit allocation because the data compression ratio in the entropy coding varies depending upon the signal property.

OBJECT AND SUMMARY OF THE INVENTION

It is therefore an object of the present invention to overcome the above-mentioned drawbacks of the related art by providing an encoding method, apparatus and program, capable of encoding multi-channel digital data with an improved efficiency by adjusting the number of bits to be allocated to the channels in entropy coding of the multi-channel digital data.

The above object can be attained by providing an encoding apparatus and method for encoding, for compression, a multi-channel signal including digital signals from a plurality of channels by framing the signal, determining the number of steps of quantizing data in the frame and making entropy coding of the signal, in which the digital signal is entropy-encoded on the basis of the provisional number of quantizing steps, a total of code length in a current frame is calculated per channel, the number of usable bits is allocated channel by channel on the basis of a ratio of the provisional number of in-use bits for each channel with the total provisional number of in-use bits, which is the sum of the provisional numbers of in-use bits for all the channels, and the number of in-use bits is adjusted on the basis of the number of usable bits allocated to each channel.

According to the present invention, the number of in-use bits for each channel can appropriately be allocated by one try because the provisional number of in-use bits for each channel is determined by once making entropy coding of digital signals, the number of usable bits is allocated on the basis of the provisional number of in-use bits and then the number of in-use bits is adjusted for approximation to the allocated number of usable bits by making entropy coding of the digital signals again.

Also, each of all the above channels includes a plurality of group channels each including two or more channels, and the provisional number of in-use bits can be calculated for a group channel including two or more channels, the number of usable bits can be allocated to each group channel on the basis of a ratio of the provisional number of in-use bits for each group channel with the total provisional number of in-use bits, which is the sum of the provisional number of in-use bits for each group channel, and the number of usable bits can appropriately allocated to each of the group channels, taking two-channel stereo signal as group channel for example.

Further, a part of the allocable total number of bits can be allocated, to each channel, as the number of usable bits which are based on the ratio of the provisional number of in-use bits for each channel with the total provisional number of in-use bits for all channels, whereby the total number of allocable bits can be allocated using any other parameter than the ratio of the provisional number of in-use bits, determined by entropy coding.

Also, the above object can be attained by providing a program that has a computer execute the above-mentioned coding.

These objects and other objects, features and advantages of the present invention will become more apparent from the following detailed description of the preferred embodiments of the present invention when taken in conjunction with the accompanying drawings.

DETAILED DESCRIPTION OF THE PREFERRED EMBODIMENTS

The present invention will be described in detail concerning a multi-channel encoder for high-efficiency coding of multi-channel digital audio data from two or more channels as an embodiment thereof with reference to the accompanying drawings herebelow.

Figure 1:
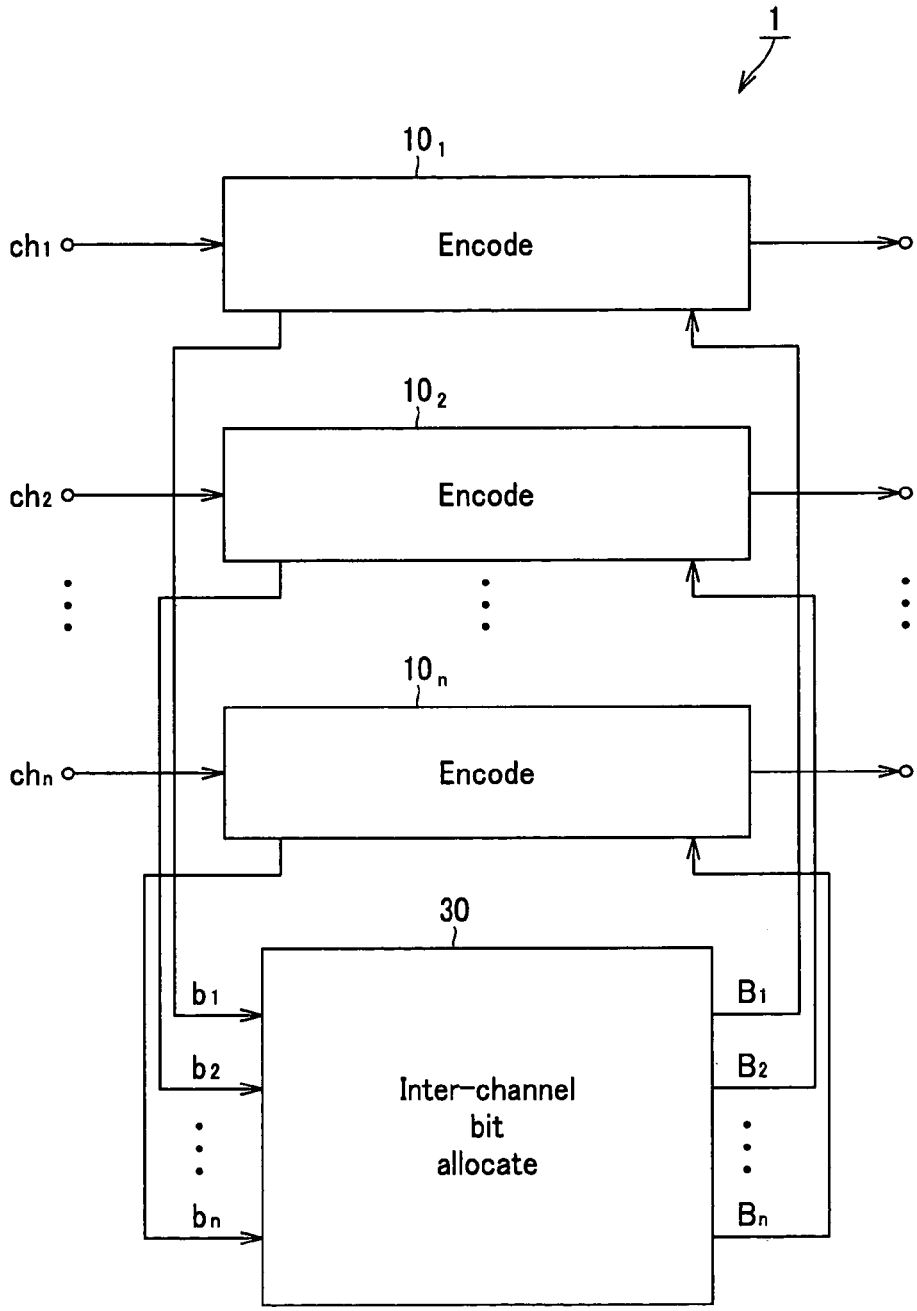
FIG. 1 is a block diagram of a multi-channel encoder according to the present invention.

Referring now to FIG. 1, there is schematically illustrated the multi-channel encoder according to the present invention in the form of a block diagram. As shown in FIG. 1, the multi-channel encoder, generally indicated with a reference 1, includes the number n (=1 to N) of encoders $\mathbf{10}_n$ for multi-channel audio data from the number n of channels, and an inter-channel bit allocator 30 that determines the number $B_n$ of usable bits for allocation to each channel by making an inter-channel bit allocation on the basis of the provisional number $b_n$ of in-use bits from each of the encoders $\mathbf{10}_n$.

Each of the encoders $\mathbf{10}_n$ includes a provisional-number-of-in-use-bits calculating means (not shown) that calculates the provisional number $b_n$ of bits by making entropy coding of each unit of coding from the provisional number of quantizing steps or size and summing code length in the units of coding. The provisional-number-of-in-use-bits calculating means supplies the provisional number $b_n$ of in-use bits to the inter-channel bit allocator 30. Further, each of the encoders $\mathbf{10}_n$ includes a number-of-bits adjusting means (not shown) that adjusts the number $B_n'$ of in-use bits correspondingly to the number $B_n$ of usable bits supplied from the inter-channel bit allocator 30. The provisional number $b_n$ of in-use bits is smaller than the number $B_n$ of usable bits. The number-of-bits adjusting means adjusts the number $B_n'$ of in-use bits for approximation to the number $B_n$ of usable bits by changing the quantizing steps etc.

The inter-channel bit allocator 30 is supplied with the provisional number $b_n$ of in-use bits for each channel, and allocates at least a part of the total number B of allocable bits as the number $B_n$ of usable bits by making inter-channel bit allocation on the basis of a ratio of the provisional number $b_n$ of in-use bits for each channel with the total provisional number of in-use bits, which is the sum of the provisional numbers of in-use bits for all the channels. Then, the inter-channel bit allocator 30 supplies the allocated number of usable bits to the encoder $\mathbf{10}_n$ corresponding to each channel. It should be noted that a part of the total number B of allocable bits may proportionally be allocated correspondingly to the provisional number $b_n$ of in-use bits for each channel, or other than the part be allocated evenly to each channel as will be described in detail later or proportionally be allocated correspondingly to an amount of information from each channel.

The inter-channel bit allocation is effected as will be described in detail below. On the assumption that the provisional number of in-use bits determined for a channel No. n in a frame is $b_n$, the total number of bits allocable to all the channels in that frame is B and all the total number B of allocable bits is allocated as the number $B_n$ of usable bits to each channel by making the inter-channel bit allocation, the number $B_n$ of usable bits can be determined to be as given by the following formula (1). Thus, bits (the number $B_n$ of usable bits) are allocated at a ratio in demand for bits between the channels.

$$B_n = B\frac{b_n}{\sum_{i=0}^{N-1} b_i} \tag{1}$$

The number $B_n$ of usable bits thus allocated is supplied to each encoder $\mathbf{10}_n$ which will determine an optimum number of quantizing steps or a size to be within the number $B_n$ of usable bits and make entropy coding.

That is, the multi-channel encoder 1 first determines a provisional number of quantizing steps or a size for a to-be-quantized signal or coefficient from all the channels taking in consideration a general balance of sound quality and image quality among all the channels, such as inter-channel relation in energy etc.

Then, the multi-channel encoder 1 quantizes the signal or coefficient on the basis of the determined provisional number of quantizing steps or size and makes entropy coding of the quantized data.

Thereafter, the multi-channel encoder 1 determines the number $B_n$ of usable bits by making a proportional inter-channel bit allocation on the basis of the sum of code length of entropy codes obtained for each channel (provisional number of in-use bits).

Thus, the multi-channel encoder 1 makes bit allocation giving consideration to a variation in compressibility ratio from one channel to another in the entropy coding, that varies depending upon the signal property while maintaining the balance in parameters as to sound or image quality such as inter-channel energy distribution, etc.

Also, since there is some correlation between the number of quantizing steps or size and the code length after the entropy coding although the number of quantizing steps and code length are not generally proportional to each other, the number of in-use bits can be adjusted by increasing or decreasing the number of quantizing steps. Therefore, even an encoder that encodes digital signal from one channel, not from multiple channels, can also adjust the number of in-use bits by repeating a series of operations including determination of number of quantizing steps, quantization and entropy coding as in a loop structure, as will be described later. For example, by connecting a plurality of one-channel encoders in parallel with each other and introducing an inter-channel bit allocating mechanism to the loop top as described above, it is possible to encode multi-channel digital signal with a reduced amount of calculation.

Also, the above theory of inter-channel bit allocation can be applied to the bit allocation to a plurality of channels in a group (group channel) as well as to an independent channel (one channel). Therefore, conventional two-channel stereo encoders can be extended to a multi-channel encoder by connecting them in parallel to each other.

Figure 2:
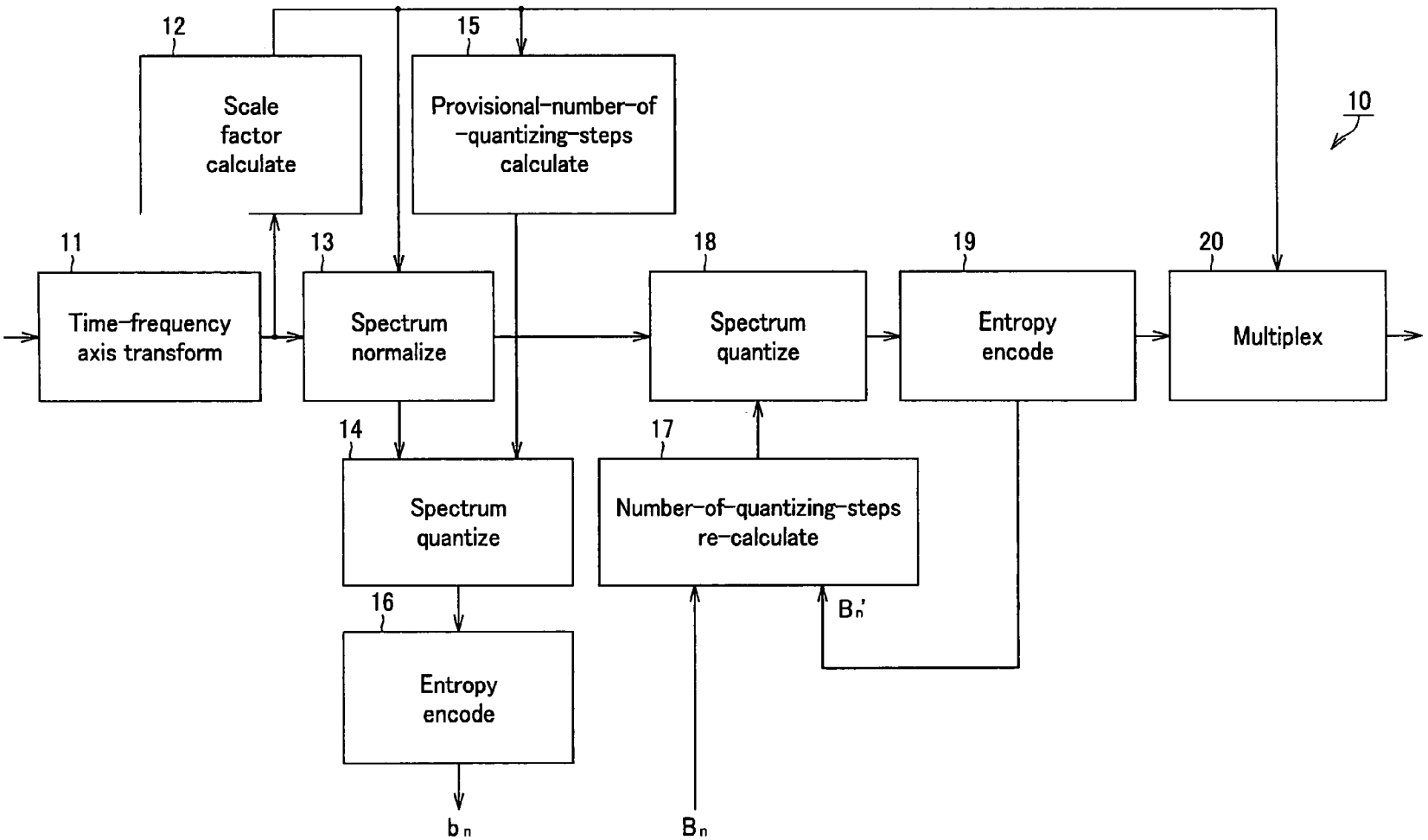
FIG. 2 is a block diagram of the encoder in the multi-channel encoder in FIG. 1.

The encoder $\mathbf{10}_n$ (will also be referred to as "encoder 10" wherever appropriate hereunder) used in the multi-channel encoder to make an optimum coding on the basis of the number of bits allocated as above according to the present invention will be described in detail below. FIG. 2 is a block diagram of the encoder 10 used in the multi-channel encoder according to the present invention. As shown in FIG. 2, the encoder 10 includes a time-frequency transformer 11 that frames an input signal and transforms the framed input signal into a spectrum of the number L of frequency domains c1 to cL by transforming a signal on a time axis into a signal on a frequency axis. The transform may be done by any of DFT, DCT, MDCT and the like. It should be noted that the input signal may be quantized as will be described in detail later without having to make such a transform. Further, the spectrum is divided frequency band by frequency band into the number M of groups. The spectrum groups resulted from the division will be called "units of coding". The units of coding range from U1 to UM. The units of coding U1 to UM are supplied to a scale factor calculator 12 and spectrum normalizer 13 also included in the encoder 10.

The scale factor calculator 12 determines a maximum value, RMS value (root mean square of each amplitude in each unit of coding) or the like of each unit of coding as a scale factor of the coefficient group to be s1 to sM, respectively. Then, it supplies the scale factors s1 to sM to the spectrum normalizer 13 and a provisional-number-of-quantizing-steps calculator 15 also included in the encoder 10.

The spectrum normalizer 13 normalizes each of the units of coding U1 to UM using the scale factors s1 to sM to provide normalized spectra C1 to CL.

The provisional-number-of-quantizing-steps calculator 15 determines numbers v1 to vM of spectrum quantizing steps for each of the units of coding U1 to UM. The accuracy of quantization can also be determined by calculating the minimum audible level and masking level in a frequency band corresponding to the units of coding U1 to UM using an auditory psychology model. However, the quantization accuracy will be determined herein simply based on the scale factors s1 to sM to flat the noise levels of the units of coding U1 to UM.

The encoder 10 also includes a spectrum quantizer 14 that quantizes the normalized spectra C1 to CL on the basis of the provisional numbers v1 to vM of quantizing steps determined by the provisional-number-of-quantizing-steps calculator 15, and a entropy encoder 16 also included in the encoder 10 makes entropy coding of the quantized normalized spectra for each of the units of coding U1 to UM. Then, the entropy encoder 16 calculates the provisional number $b_n$ of in-use bits, resulted from summing of the code length of the units of coding U1 to UM, and supplies the result of calculation to the inter-channel bit allocator 30 shown in FIG. 1.

The above time-frequency axis transformer 11, scale factor calculator 12, spectrum normalization block 13, spectrum quantizer 14, provisional-number-of-quantizing-steps calculator 15 and entropy encoder 16 form together the above provisional-number-of-in-use-bits calculator.

The encoder 10 further includes a number-of-quantizing-steps re-calculator 17. The number-of-quantizing-steps re-calculator 17 is supplied with the number $B_n$ of usable bits allocated by the inter-channel bit allocator 30 shown in FIG.

1, re-calculates the number of quantizing steps, and supplies the recalculated number of quantizing steps to a spectrum quantizer 18. The spectrum quantizer 18 is supplied with the normalized spectra C1 to CL from the spectrum normalizer 13, quantizes them on the basis of the recalculated number of quantizing steps and sends the re-calculated number of quantizing steps to an entropy encoder 19 also included in the encoder 10. The entropy encoder 19 make entropy coding of the re-calculated number of quantizing steps and sends the code to a multiplexer 20 which will multiplex the code and scale factor and output the multiplexed data.

The number-of-quantizing-steps re-calculator 17, spectrum quantizer 18 and entropy encoder 19 are adjusted as will be described below so that the number of quantizing steps are updated for an optimum one.

That is, the inter-channel bit allocator 30 makes inter-channel bit allocation on the basis of the provisional number $b_n$ of in-use bits supplied from each of the encoders $\mathbf{10}_n$, and return the number $B_n$ of usable bits to each encoder $\mathbf{10}_n$, which will adjust the number of in-use bits to smaller than the number $B_n$ of usable bits.

Note here that the number-of-quantizing-steps re-calculator 17 may also be arranged to have information such as a provisional number of quantizing steps or size, provisional number $b_n$ of in-use bits, etc., and adjust the number of in-use bits through comparison between the provisional number $b_n$ of in-use bits and supplied number $B_n$ of usable bits. As above, since there is some correlation between the number of quantizing steps and the code length after the entropy coding although the number of quantizing steps and code length are not proportional to each other, the number of in-use bits can be adjusted by increasing or decreasing the number of quantizing steps.

That is, when the number $B_n$ of usable bits is smaller than the provisional number $b_n$ of in-use bits, a part or all of the provisional numbers v1 to vM of quantizing steps is decreased. On the contrary, when the number $B_n$ of usable bits is larger than the provisional number $b_n$ of in-use bits, a part or all of the provisional numbers v1 to vM of quantizing steps is increased.

The spectrum quantizer 18 quantizes the spectrum in the re-calculated number of quantizing steps, and the entropy encoder 19 determines the total code length $B_n'$ (number of in-use bits), which is a sum of code length of the units of coding, by making entropy coding for each units of coding. The entropy encoder 19 compares the number $B_n'$ of in-use bits and number $B_n$ of usable bits, and adjust the number $B_n'$ of in-use bits, by increasing or decreasing the number of quantizing steps, so that the number $B_n'$ of in-use bits will be less than and near the number $B_n$ of usable bits.

That is, when the number $B_n$ of usable bits is smaller than the number $B_n'$ of in-use bits, a part or all of the numbers v1 to vM of quantizing steps is decreased. On the contrary, when the number $B_n$ of usable bits is larger than the number $B_n'$ of in-use bits, a part or all of the numbers v1 to vM of quantizing steps is increased.

The above number-of-quantizing-steps re-calculator 17, spectrum quantizer 18 and entropy encoder 19 form together the aforementioned number-of-bits adjusting means.

Note here that although in each channel, the number of in-use bits is adjusted by repeating a series of operations including the determination of number of quantizing steps, quantization and entropy coding as in a loop structure, the number-of-quantizing-steps re-calculator 17 can output a result of entropy coding effected taking the number of quantizing steps as a provisional number of in-use bits directly to the multiplexer 20 when the provisional number $b_n$ of in-use bits is smaller than or equal to the number $B_n$ of usable bits, and also exit the above series of operations when the number $B_n'$ of in-use bits is smaller than or equal to the number $B_n$ of usable bits, with outputting the result of entropy coding at that time to the multiplexer 20. Also, the number-of-quantizing-steps re-calculator 17 may re-calculate the number of quantizing steps on the basis of the scale factors s1 to sM and number $B_n$ of usable bits to adjust the number $B_n'$ of in-use bits.

Figure 3:
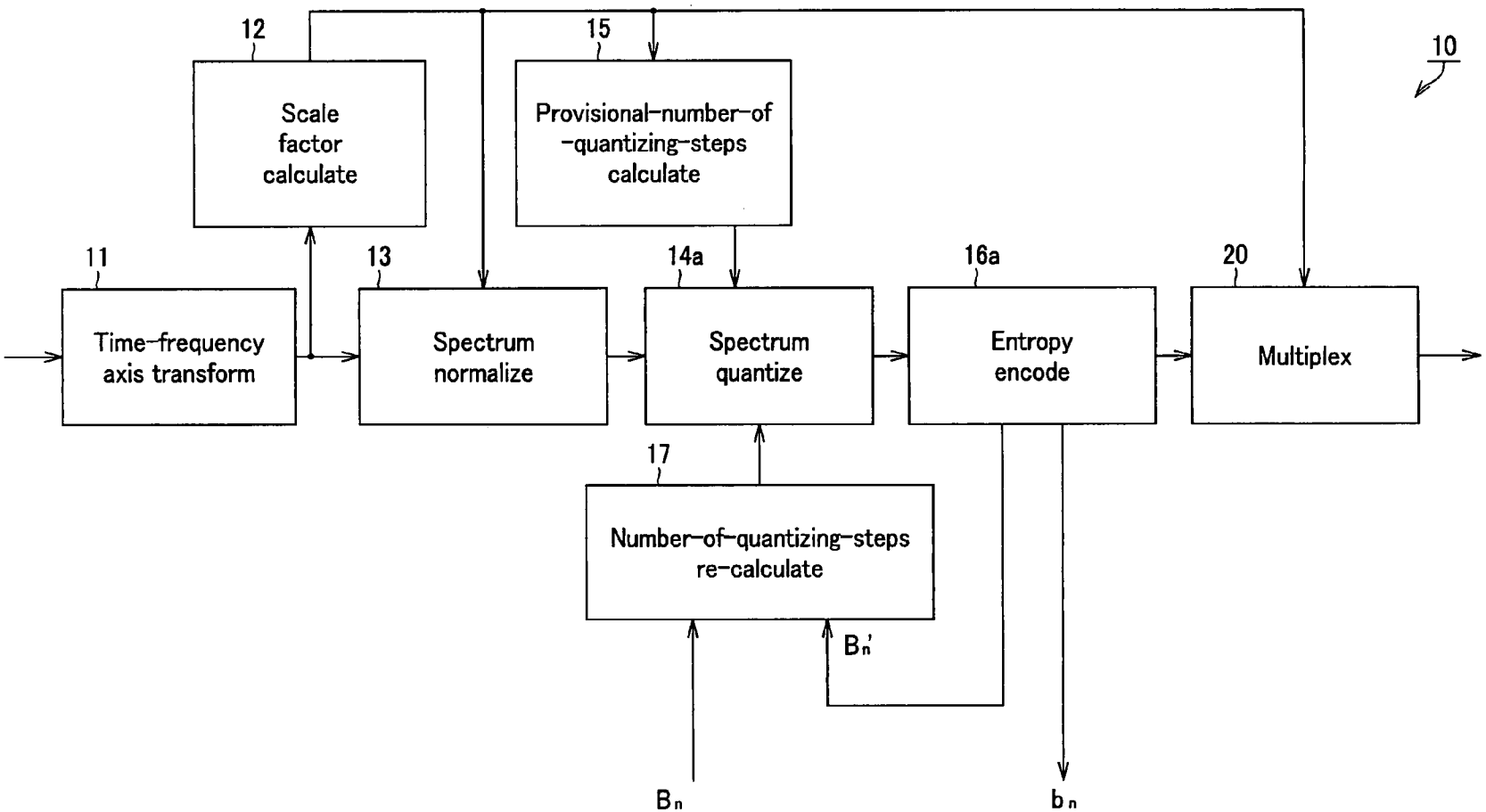
FIG. 3 is a block diagram of a variant of the encoder in the multi-channel encoder in FIG. 1.

As shown in FIG. 2, the multi-channel encoder 10 includes the spectrum quantizer 14 that makes quantization on the basis of the provisional number of quantizing steps, entropy encoder 16 that encodes the output from the spectrum quantizer 14, spectrum quantizer 18 that makes quantization on the basis of the re-calculated number of quantizing steps, and entropy encoder 19 that encodes the output from the spectrum quantizer 18. However, these blocks may be formed in the same circuit or as a program code. That is, the two spectrum quantizers 14 and 18, and two entropy encoders 16 and 19, may be combined into a spectrum quantizer 14*a* and entropy encoder 16*a*, respectively, as shown in FIG. 3.

Figure 4:
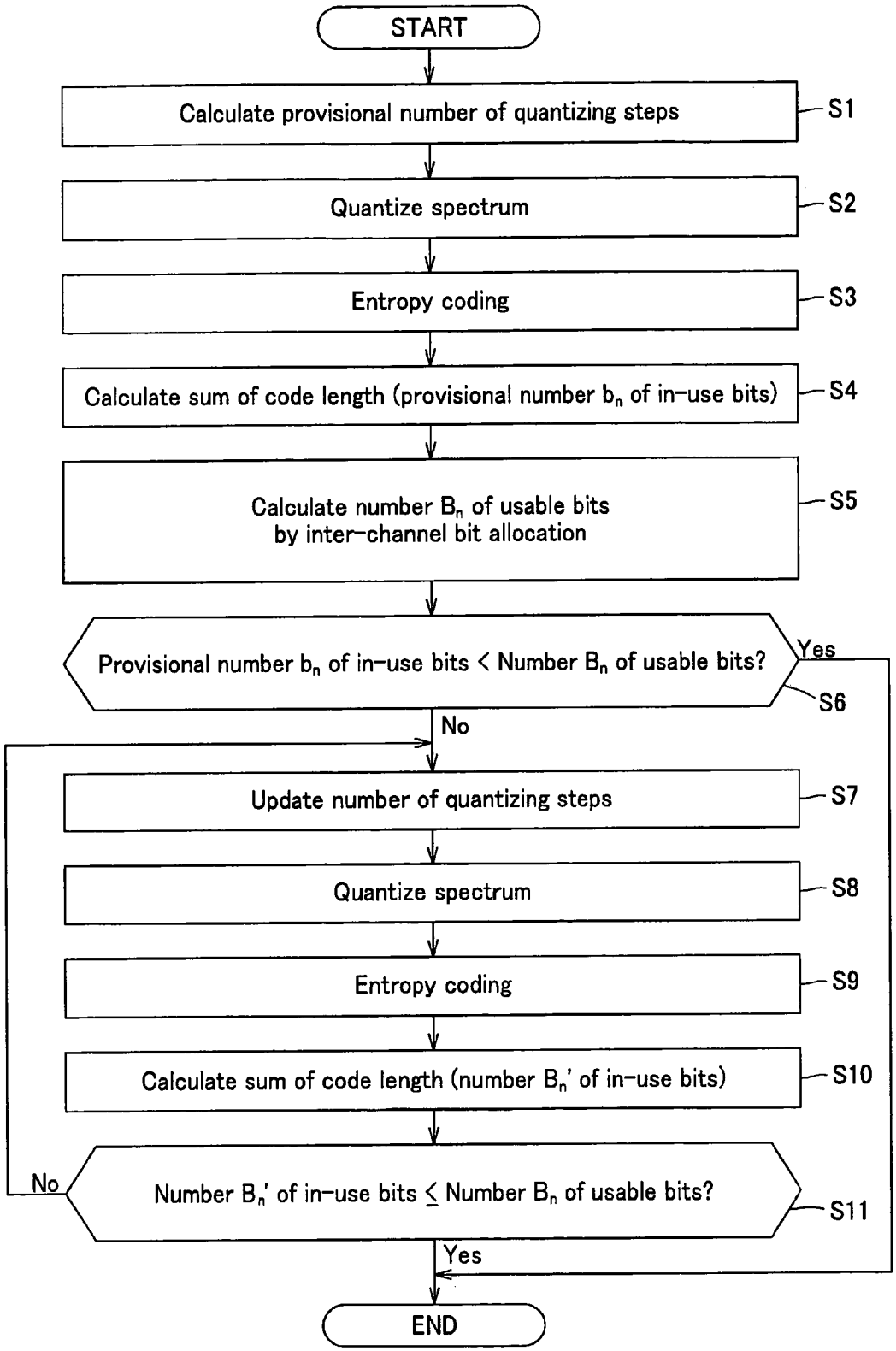
FIG. 4 shows a flow of operations made in encoding audio data from multiple channels according to the present invention.

The encoding method according to the present invention, adopted in the multi-channel encoder 1 and encoder 10 as shown in FIGS. 1 and 2, will be described below with reference to FIG. 4 showing a flow of operations made in encoding audio data from multiple channels.

As shown in FIG. 4, firstly in each of the encoders $\mathbf{10}_n$, a provisional number of quantizing steps is calculated (in step S1), time-frequency axis-transformed and normalized data is quantized on the basis of the provisional number of quantizing steps (in step S2), and entropy-encoded (in step S3). Then, a total code length of the entropy codes is determined as a provisional number $b_n$ of bits in use (in step S4).

Next, the inter-channel bit allocator 30 in FIG. 1 makes an inter-channel bit allocation using the aforementioned formula (1) on the basis of the provisional number $b_n$ of in-use bits supplied from each encoder $\mathbf{10}_n$ to provide the number $B_n$ of usable bits as a maximum number of bits usable for each channel (in step S5).

Then, the number $B_n$ of usable bits is supplied to each encoder $\mathbf{10}_n$ in which the number-of-quantizing-steps re-calculator 17, etc., in FIG. 2 or 3 for example will judge whether the provisional number $b_n$ of in-use bits is smaller than the number $B_n$ of usable bits (in step S6). When the provisional number $b_n$ of in-use bits is smaller than the number $B_n$ of usable bits, the number of quantizing steps is updated (re-calculated) to increase a part or all of the provisional numbers v1 to vM of quantizing steps, while if the provisional number $b_n$ of in-use bits is larger than the number $B_n$ of usable bits, the number of quantizing steps is updated (re-calculated) to decrease the part or all of the provisional numbers v1 to vM of quantizing steps (in step S7).

Thus, spectrum quantization is effected on the basis of the new number of quantizing steps (in step S8), entropy coding is done (in step S9), and a sum of code length of the entropy codes (number $B_n'$ of in-use bits) is calculated (in step S10). Then, in the entropy encoder 19 in FIG. 2 or entropy encoder 16*a* in FIG. 3, it is judged whether the number $B_n'$ of in-use bits is smaller than or equal to the number $B_n$ of usable bits (in step S11). When the number $B_n'$ of in-use bits is smaller than the number $B_n$ of usable bits, the entropy code is multiplexed with the scale factor, and the multi-channel encoder 10 exits the process with the output from the encoder 19 or 16*a* being taken as an output from the encoder 10.

On the other hand, if the number $B_n'$ of in-use bits is larger than the number $B_n$ of usable bits, the multi-channel encoder 10 repeats the operations in step S7 and subsequence steps to adjust the number of quantizing steps for the number $B_n'$ to be smaller than the number $B_n$. Then, the re-normalized spectra C1 to CN are quantized on the basis of the updated numbers v1' to vM' of quantizing steps, and the spectra are entropy-encoded. Subsequently, these operations are repeated until the number $B_n'$ of in-use bits falls within a predetermined range, or smaller than the number $B_n$ of usable bits.

Note here that if the number $B_n'$ of in-use bits is much smaller than the number $B_n$ of usable bits, the amount of entropy code may be increased by repeating the operations in steps S7 to S9 and increasing the number of quantizing steps or similar operation.

Although it was described that in step S5, the inter-channel bit allocator 30 in FIG. 1 makes the bit allocation by the formula (1), the provisional number $b_n$ of in-use bits is small because of the high-efficiency compression of the entropy coding, for example, in some cases. In such a case, if the total number B of bits allocable to all the channels is absolutely insufficient, the inter-channel bit allocation will lead to a larger decrease of the number $B_n$ of usable bits to be allocated than necessary and the channels in consideration will excessively deteriorated in some case. On this account, the formula (1) can be corrected as given by the formula (2) by allocating a part of the total number B of allocable bits by any other method:

$$B_n = (1-r)B\frac{b_n}{\sum_{i=0}^{N-1} b_i} + rB\delta_n \tag{2}$$

where $\delta_n$ meets the following condition:

$$\sum_{i=0}^{N-1} \delta_n = 1$$

and where $B_n$ is a sum of the number of bits allocated correspondingly to the provisional number of bits in each channel and the number of bits allocated by the other method and r is a constant of smaller than one, appropriately set correspondingly to the signal type, magnitude of the total number B of allocable bits, etc.

The above correction is made by two methods as will be described in detail below. One of the methods is to meet a condition given by the following formula (3) by allocating rB/N bits fixedly to each of channels ($ch_1$ to $ch_N$), to thereby assure a minimum number of bits:

$$\delta_n = \frac{1}{N} \quad (0 \le n \le N) \tag{3}$$

The second method is to meet a condition given by the following formula (4):

$$V_n = \sum_{k=1}^{M} l_k \log_2(v_k) \tag{4}$$

where Vn is a value resulted by summing products of a logarithm and coefficient of the quantizing step and numbers $1_1$ to $1_M$ of spectra forming the units of coding U1 to UM concerning all the units of coding and which indicates a code length when no compression by entropy coding has been done; it is an amount of information in the channels n. Using the value $V_n$, the formula (4) can be corrected into the following formula (5):

$$\delta_n = \frac{V_n}{\sum_{i=0}^{N-1} V_i} \tag{5}$$

Then, an inter-channel bit allocation well balanced between the compression by the entropy coding and the amount of information can be implemented by appropriately adjusting the constant r included in the aforementioned formula (2).

Figure 5:
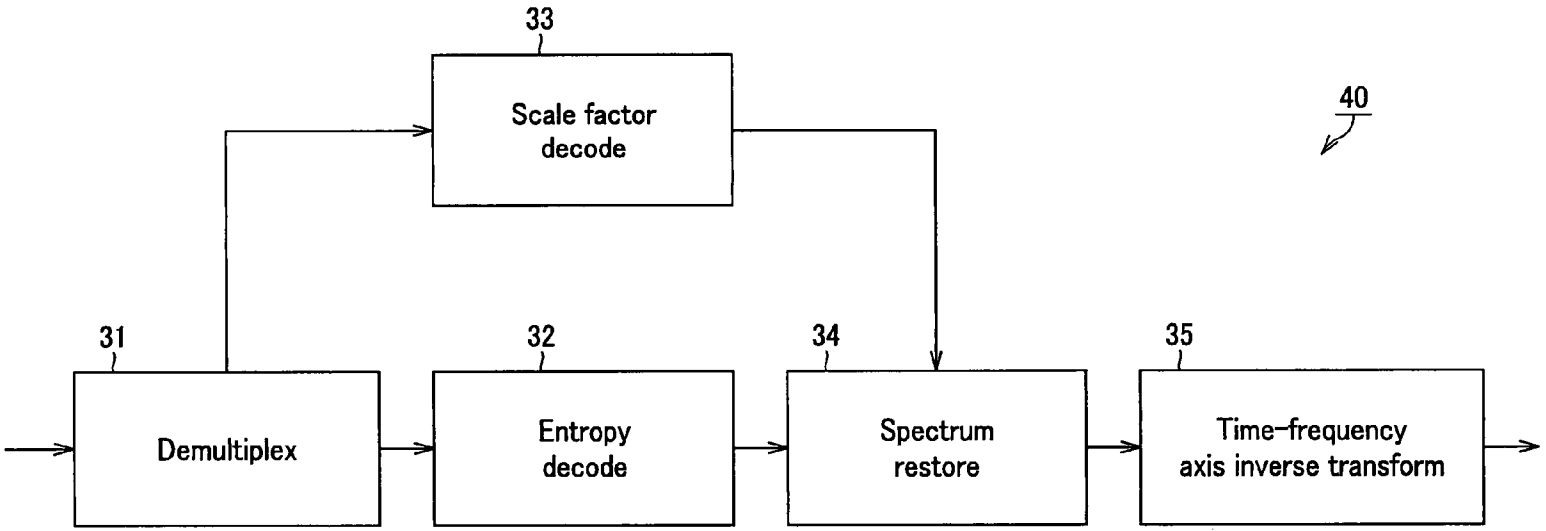
FIG. 5 is a block diagram of the decoder that decodes data encoded by the multi-channel encoder in FIG. 1.

Also, data encoded by the multi-channel encoder shown in FIG. 1 can be decoded by an ordinary monaural decoder. FIG. 5 is a block diagram of the decoder that decodes data encoded by the multi-channel encoder according to the present invention.

As shown in FIG. 5, in the decoder, generally indicated with a reference 40, the output from each encoder $\mathbf{10}_n$, resulted from multiplexing of the entropy code and scale factor, is demultiplexed by a demultiplexer 31 into a spectrum code and scale factor code, and supplied to an entropy decoder 32 and scale factor decoder 33. The entropy decoder 32 provides a normalized spectrum, and the scale factor decoder 33 provides a decoded scale factor. Then, a spectrum restoration block 34 restores the original spectrum from the normalized spectrum using the decoded scale factor, and a time-frequency axis inverse transformer 35 restores the time signal. Thereby, the audio signal is decoded.

Figure 6:
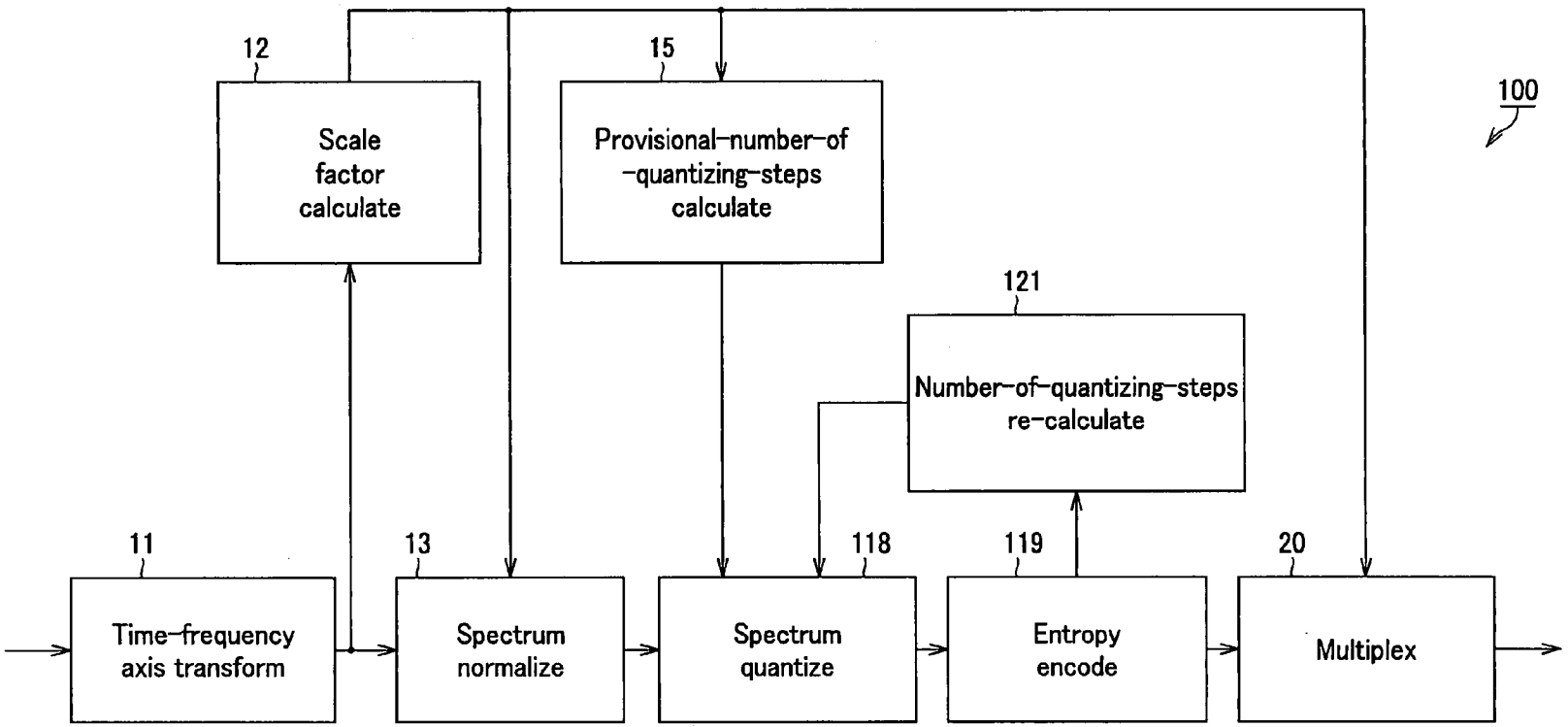
FIG. 6 is a block diagram of a monaural encoder for entropy coding.

Note here that the multi-channel encoder $\mathbf{10}_n$ shown in FIG. 1 can be modified into an extremely simplified multi-channel encoder just by a slight extension of the monaural encoder. More specifically, in a monaural encoder 100 shown in FIG. 6, an input digital signal is framed, and a time-axial signal is transformed by the time-frequency axis transformer 11 into a frequency-axial signal, as shown in FIGS. 2 and 3. Thereafter, the signal is divided band by band into units of coding. The units of coding are normalized by the spectrum normalizer 13, and quantized by a spectrum quantizer 118 on the basis of the provisional number of quantizing steps. The quantized signal is entropy-encoded by an entropy encoder 119, and thus a sum of code length of entropy code of the units of coding (total number of bits) is determined. At this time, when the number of bits exceeds a maximum number of bits pre-specified for each frame, the number of quantizing steps is re-calculated by a number-of-quantizing-steps re-calculator 121, quantized and entropy-encoded, an operation for determining the number of in-use bits is repeated, and the number of bits is adjusted to be less than the pre-specified maximum number of bits.

Figure 7:
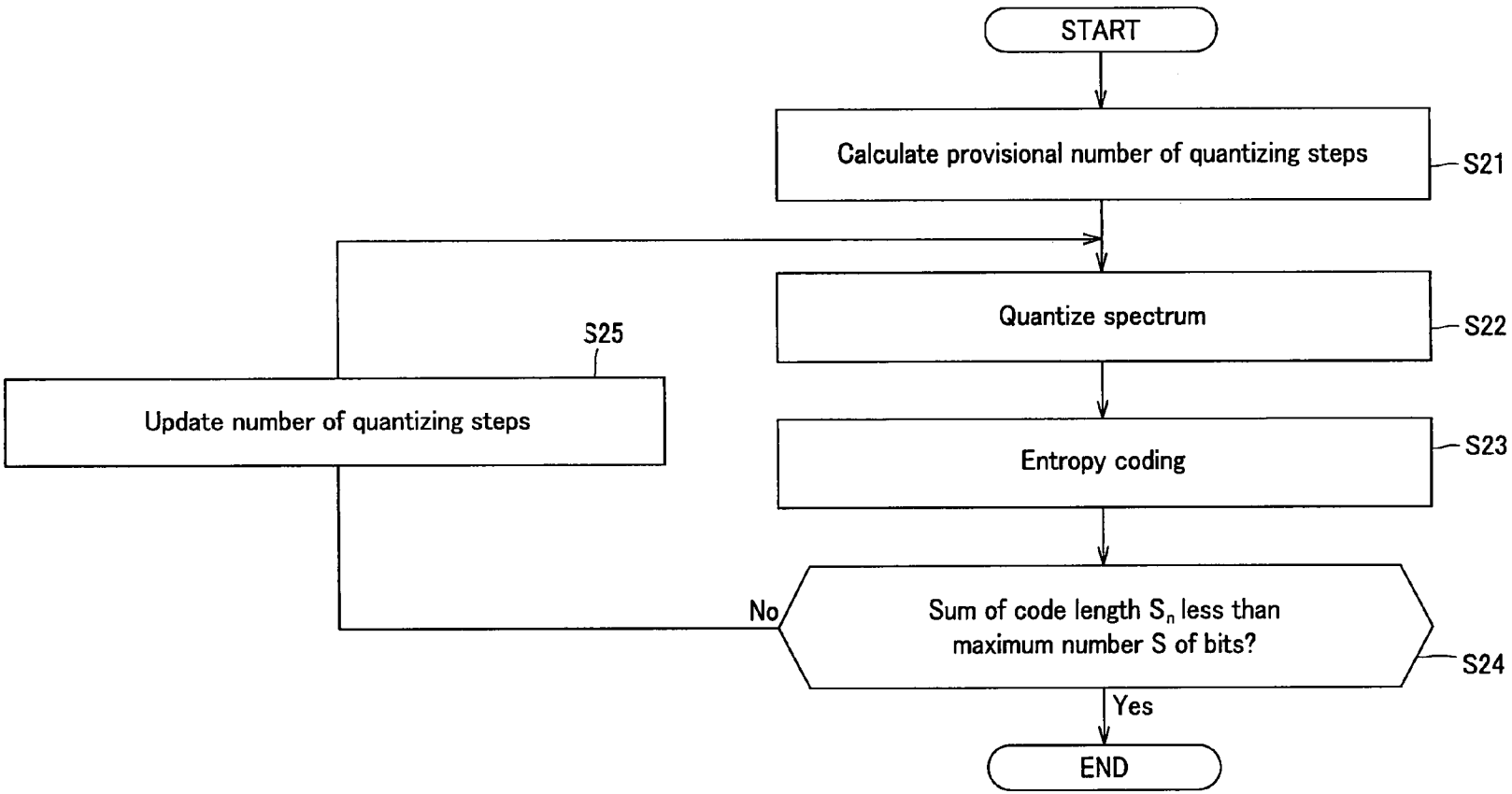
FIG. 7 shows a flow of operations made in the monaural encoder for the entropy coding.

That is, as shown in FIG. 7, a provisional number of quantizing steps is calculated (in step S21), spectrum is quantized (in step S22), and entropy-encoded (in step S23). A number Sn of in-use bits, resulted from summing the code length of the units of coding thus determined is supplied to the number-of-quantizing-steps re-calculator 121, for example. The number-of-quantizing-steps re-calculator 121 holds a maximum number of bits allocated to the spectrum in the current frame as a constant S, and judges whether the number Sn of in-use bits is smaller than or equal to the maximum number S of bits (in step S24). When the number Sn of in-use bits is neither smaller than nor equal to the maximum number S of bits, the number of quantizing steps is re-calculated (in step S25) and the operations in step S21 and subsequent steps are repeated to adjust the number of bits so that the number Sn of in-use bits is smaller than or equal to the maximum number S of bits.

In the above monaural encoder, multi-channel digital signals can be encoded with a high efficiency by supplying the number of in-use bits, provided by the quantization on the basis of the provisional number of quantizing steps and entropy coding, to the external inter-channel bit allocator 30, taking the number of usable bits as the maximum number of bits from the inter-channel bit allocator 30 and adjusting the number of in-use bits corresponding to the number of in-use bits. That is, the monaural encoder can be modified to be equivalent to a multi-channel encoder by providing a mechanism that adjusts the number of in-use bits to the number of allocated bits, externally determined after providing a provisional number of in-use bits to outside or by designing the monaural encoder in which such a mechanism can additionally be provided.

Also, the number of channels whose signals are processed by the encoders $\mathbf{10}_n$ at the same time is not necessarily limited to one. Therefore, an encoder that processes signals from a plurality of channels can also be designed similarly. That is, on the assumption that the encoder $\mathbf{10}_n$ shown in FIG. 1 is a two-channel stereo encoder, a multi-channel encoder for a total of 2N channels can be designed by connecting the number N of the encoders $\mathbf{10}_n$ in parallel to each other as shown in FIG. 1.

In this case, each encoder outputs a provisional number of in-use bits for two channels to the inter-channel bit allocator which will allocate the number of usable bits for the two channels and send it to the two-channel stereo encoder. The two-channel stereo encoder adjusts the number of usable bits for the two channels for each of the channels. Also, the inter-channel bit allocator sums the provisional numbers of in-use bits for the two channels, and allocates a part or all of the total number B of allocable bits to each two-channel stereo encoder correspondingly to the provisional number of in-use bits for the two channels, in the sum of the provisional numbers of in-use bits. It should be noted that the encoder $\mathbf{10}_n$ may of course be a mixture of a two-channel stereo encoder and a monaural encoder.

According to the present invention, encoders for encoding signals from relatively less channels, or monaural or two-channel encoders as in the above embodiment, are connected in parallel to each other and an inter-channel bit allocator is additionally provided as a mechanism to adjust the allocation of bits for entropy coding between the encoders. Thus, a multi-channel coding can be implemented. The modification of the conventional encoder for the present invention is basically a part relevant to the entropy coding alone, and only the inter-channel bit allocator 30 should additionally be provided as a part that allocates bits between the encoders. In the case where the multi-channel encoder according to the present invention is implemented as a software, it can easily coexist with the conventional encoder and excellent in maintenability of the software. Also, since the amount of computation necessary for the bit allocation between the encoders is extremely small, the multi-channel encoder is highly advantageous in the running costs as well.

Also, since the bit allocator is supplied with a demand for bits, variable depending upon the property of an original signal from a channel as a provisional number of in-use bits without any explicit analysis of the signal, it can make an inter-channel bit allocation according to the demand for bits. For example, in an audio encoding system in which an input signal is transformed by DFT or DCT into a coefficient in a frequency domain and the coefficient is entropy-encoded, any tendency that a larger value of the coefficient leads to a longer output code length of the entropy coding roughly means that a short code length will be allocated to a highly tonal signal as an output of the entropy coding while a long code length will be allocated to a noise-like signal. A coding system of this kind, if applied, will function so that less bits are allocated to a channel from which tonal signals come, while more bits are allocated to a channel from which noise-like signals come, and adaptively allocate a necessary number of bits for maintaining a sound quality of each channel constant.

Further, since a function of adjusting the number of in-use bits by making a comparison between a calculated provisional number of in-use bits and the number of usable bits is added to a monaural encoder, the framework of the coding system has not to be changed and the existing decoder as shown in FIG. 5 may be used as it is.

In the foregoing, the present invention has been described in detail concerning certain preferred embodiments thereof as examples with reference to the accompanying drawings. However, it should be understood by those ordinarily skilled in the art that the present invention is not limited to the embodiments but can be modified in various manners, constructed alternatively or embodied in various other forms without departing from the scope and spirit thereof as set forth and defined in the appended claims. For example, the aforementioned embodiment has been described as a hardware, but the present invention is not limited to such a hardware. A CPU (central processing unit) may be made to execute an arbitrary computer program. In this case, the computer program can be provided as a record in a recording medium to the user or transmitted to the user via the Internet or any other transmission medium.

In addition, although the encoder to encode audio digital data from multiple channels has been described in the foregoing, it is not limited to encoding of audio digital signal, but in simultaneous coding of such audio digital data as well as multi-channel video data, the data are entropy-encoded once to provide a provisional number of in-use bits and the number of usable bits is distributed on the basis of the provisional number of in-use bits, to thereby permitting an allocation of an optimum number of bits corresponding to the characteristic (property) of each channel.

As having been described in the foregoing, according to the present invention, when compressing, by coding, a multi-channel signal of digital signals from a plurality of channels by framing, determining the number of steps of quantizing data in a frame and making entropy coding of the signal, the digital signals are entropy-encoded on the basis of the provisional number of quantizing steps, provisionally determined, a sum of code length in a current frame is calculated as a provisional number of in-use bits in the current frame for each channel, the number of usable bits is allocated to each channel on the basis of a ratio of the provisional number of in-use bits for each channel and a total number of in-use bits, which is the sum of the provisional numbers of in-use bits in the current frame, and the number of in-use bits is adjusted on the basis of the number of usable bits allocated to each channel, thereby permitting to extend a monaural encoder, for example, to easily extend a multi-channel encoder by an inter-channel bit allocation in which the number of bits is allocated to each channel and to allocate an optimum number of bits correspondingly to a ratio in demand for bits between the multiple channels. Thus, the entropy coding can be done with a high efficiency.

What is claimed is:

1. An encoding apparatus that encodes for compression a multi-channel signal including digital signals from a plurality of channels by framing the multi-channel signal, determining a number of steps of quantizing data in the frame; and performing entropy coding of the digital signals, the apparatus comprising:

provisional-number-of-in-use-bits calculating means for calculating a sum of code length in a current frame as a provisional number of in-use bits for each channel by making entropy coding of the digital signals based on a provisional number of quantizing steps provisionally determined for quantizing the digital signals;

inter-channel bit allocation means for allocating a number of bits usable for each channel based on a ratio of the provisional number of in-use bits for each channel with a total provisional number of in-use bits, which is a sum of the provisional numbers of the in-use bits for all the plurality of channels, and number-of-bits adjusting means for adjusting the number of in-use bits for each channel based on the number of usable bits allocated to the channel, in which the provisional-number-of-in-use-bits calculating means includes means for dividing data in the current frame into units of coding, means for normalizing data included in the units of coding using a number of scale factors, means for determining the provisional number of quantizing steps based on the number of scale factors, means for quantizing normalized data obtained from the means for normalizing on the basis of the provisional number of quantizing steps obtained from the means for determining the provisional number of quantizing steps, and means for entropy coding quantized normalized data obtained from the means for quantizing normalized data and for obtaining the provisional number of in-use bits, wherein the number-of-bits adjusting means includes means for calculating a re-calculated number of quantizing steps on the basis of the provisional number of quantizing steps for each channel and a comparison of the provisional number of in-use bits for each channel with the corresponding number of usable bits, wherein the re-calculated number of quantizing steps is greater than the provisional number of quantizing steps when the provisional number of in-use bits is less than the number of usable bits for the corresponding channel and is less than the provisional number of quantizing steps when the provisional number of in-use bits is greater than the number of usable bits for the corresponding channel, and wherein the means for quantizing is for quantizing the normalized data obtained from the means for normalizing data on the basis of the re-calculated number of quantizing steps obtained from the means for re-calculating, and wherein the means for entropy coding is for entropy encoding the re-calculated quantized normalized data and for obtaining a number of in-use bits, wherein the means for entropy encoding compares the number of in-use bits for each channel with the corresponding number of usable bits and obtains an adjusted number of in-use bits, which is less than or equal to the usable bits, by increasing the number of quantizing steps of the re-calculated quantized normalized data when the number of in-use bits for each channel is less than the corresponding number of usable bits and by decreasing the number of quantizing steps of the re-calculated quantized normalized data when the number of in-use bits for each channel is greater than the corresponding number of usable bits.

2. The encoding apparatus as set forth in claim 1, wherein:

the plurality of channels includes a plurality of group channels each including two or more channels;

the provisional-number-of-in-use-bits calculating means calculates the provisional number of in-use bits in each group channel; and the inter-channel bit allocation means allocates the number of bits usable for each group channel based on a ratio of the provisional number of in-use bits for each group channel with the total provisional number of in-use bits, which is a sum of the provisional numbers of in-use bits for each group channel.

3. The encoding apparatus as set forth in claim 1, wherein the means for dividing data transforms a time-axis signal into a frequency-axis signal and divides the frequency-axis signal into the units of coding.

4. The encoding apparatus as set forth in claim 1, wherein the inter-channel bit allocation means allocates a part of a total number of allocable bits as the number of usable bits corresponding to the ratio of the provisional number of in-use bits for each channel with the total provisional number of in-use bits for all the channels.

5. The encoding apparatus as set forth in claim 4, wherein the inter-channel bit allocation means allocates other than the part of the total number of allocable bits evenly for each channel.

6. The encoding apparatus as set forth in claim 4, wherein the inter-channel bit allocation means makes a proportional allocation of other than the part of the total number of allocable bits for each channel correspondingly to a code length in which each digital signal is encoded without being compressed.

7. The encoding apparatus as set forth in claim 1, wherein the digital signals are digital audio signals.

8. An encoding method of encoding for compression a multi-channel signal including digital signals from a plurality of channels by framing the multi-channel signal, determining a number of steps of quantizing data in the frame, and performing entropy coding of the digital signals, the method comprising the steps of:

calculating a sum of code length in a current frame as a provisional number of in-use bits for each channel of the plurality of channels by performing entropy coding of the digital signals based on a provisional number of quantizing steps provisionally determined for quantizing the digital signals;

allocating a number of bits usable for each channel based on a ratio of the provisional number of in-use bits for each channel with a total provisional number of in-use bits, which is a sum of the provisional numbers of in-use bits for all the plurality of channels, and adjusting the number of in-use bits for each channel based on the number of usable bits allocated to the channel, in which the calculating step includes dividing data in the current frame into units of coding, normalizing data included in the units of coding using a number of scale factors to obtain normalized data, determining the provisional number of quantizing steps based on the number of scale factors, quantizing the normalized data on the basis of the determined provisional number of quantizing steps to obtain quantized normalized data, and entropy coding the quantized normalized data and obtaining the provisional number of in-use bits in which the adjusting step includes:

calculating a re-calculated number of quantizing steps on the basis of the provisional number of quantizing steps for each channel and a comparison of the provisional number of in-use bits for each channel with the corresponding number of usable bits, wherein the re-calculated number of quantizing steps is greater than the provisional number of quantizing steps when the provisional number of in-use bits is less than the number of usable bits for the corresponding channel and is less than the provisional number of quantizing steps when the provisional number of in-use bits is greater than the number of usable bits for the corresponding channel, quantizing the normalized data on the basis of the re-calculated number of quantizing steps, and entropy encoding the re-calculated quantized normalized data and obtaining a number of in-use bits, wherein the entropy encoding includes comparing the number of in-use bits for each channel with the corresponding number of usable bits and obtaining an adjusted number of in-use bits, which is less than or equal to the usable bits, by increasing the number of quantizing steps of the re-calculated quantized normalized data when the number of in-use bits for each channel is less than the corresponding number of usable bits and by decreasing the number of quantizing steps of the re-calculated quantized normalized data when the number of in-use bits for each channel is greater than the corresponding number of usable bits.

9. The encoding method as set forth in claim 8, wherein:

the plurality of channels includes a plurality of group channels each including two or more channels;

the provisional number of in-use bits in each group channel is calculated in the provisional-number-of-in-use-bits calculating step; and the number of bits usable for each group channel based on a ratio of the provisional number of in-use bits for each group channel with the total provisional number of in-use bits, which is a sum of the provisional numbers of in-use bits for each group channel, is allocated in the inter-channel bit allocation step.

10. The encoding method as set forth in claim 8, wherein in the provisional-number-of-in-use-bits calculating step, a time-axis signal is transformed into a frequency-axis signal and the frequency-axis signal is divided into the units of coding.

11. The encoding method as set forth in claim 8, wherein in the inter-channel bit allocation step, a part of the total number of allocable bits is allocated as the number of usable bits corresponding to the ratio of the provisional number of in-use bits for each channel with the total provisional number of in-use bits for all the plurality of channels.

12. The encoding method as set forth in claim 11, wherein in the inter-channel bit allocation step, there is allocated other than the part of the total number of allocable bits evenly for each channel.

13. The encoding method as set forth in claim 11, wherein in the inter-channel bit allocation step, there is made a proportional allocation of other than the part of the total number of allocable bits for each channel correspondingly to a code length in which each digital signal is encoded without being compressed.

14. The encoding method as set forth in claim 8, wherein the digital signals are a digital audio signals.

15. A computer readable recording medium having a program recorded therein for allowing a computer to encode for compression a multi-channel signal including digital signals from a plurality of channels by framing the multi-channel signal, determining a number of steps of quantizing data in the frame, and performing entropy coding of the signals, the program comprising the digital steps of:

calculating a sum of code length in a current frame as a provisional number of in-use bits for each channel of the plurality of channels by entropy coding of the digital signals based on a provisional number of quantizing steps provisionally determined for quantizing the digital signals;

allocating a number of bits usable for each channel based on a ratio of a provisional number of in-use bits for each channel with the total provisional number of in-use bits, which is a sum of the provisional numbers of in-use bits for all the plurality of channels, and adjusting the number of in-use bits for each channel based on the number of usable bits allocated to the channel, in which the calculating step includes dividing data in the current frame into units of coding, normalizing data included in the units of coding using a number of scale factors to obtain normalized data, determining the provisional number of quantizing steps based on the number of scale factors, quantizing the normalized data on the basis of the determined provisional number of quantizing steps to obtain quantized normalized data, and entropy coding the quantized normalized data and obtaining the provisional number of in-use bits, and in which the adjusting step includes:

calculating a re-calculated number of quantizing steps on the basis of the provisional number of quantizing steps for each channel and comparison of the provisional number of in-use bits for each channel with the corresponding number of usable bits, wherein the re-calculated number of quantizing steps is greater than the provisional number of quantizing steps when the provisional number of in-use bits is less than the number of usable bits for the corresponding channel and is less than the provisional number of quantizing steps when the provisional number of in-use bits is greater than the number of usable bits for the corresponding channel, the re-calculated number of quantizing steps is less than the provisional number of quantizing steps, quantizing the normalized data on the basis of the re-calculated number of quantizing steps, and entropy encoding the re-calculated quantized normalized data and obtaining a number of in-use bits, wherein the entropy encoding includes comparing the number of in-use bits for each channel with the corresponding number of usable bits and obtaining an adjusted number of in-use bits, which is less than or equal to the usable bits, by increasing the number of quantizing steps of the re-calculated quantized normalized data when the number of in-use bits for each channel is less than the corresponding number of usable bits and by decreasing the number of quantizing steps of the re-calculated quantized normalized data when the number of in-use bits for each channel is greater than the corresponding number of usable bits.

* * * * *